US005150647A

United States Patent [19]

Mohr

[11] Patent Number: 5,150,647

[45] Date of Patent: Sep. 29, 1992

[54] APPARATUS FOR SEVERING STACKS OF SHEETS

[76] Inventor: Wolfgang Mohr, Hundshager Weg 42, D-6238 Hofheim, Fed. Rep. of Germany

[21] Appl. No.: 427,979

[22] Filed: Oct. 26, 1989

Related U.S. Application Data

[63] Continuation of Ser. No. 38,886, Apr. 15, 1987, abandoned.

[30] Foreign Application Priority Data

Apr. 19, 1986 [DE] Fed. Rep. of Germany ..... 3613315

[51] Int. Cl.[5] ..... B30B 9/20

[52] U.S. Cl. ..... 100/90; 100/210; 414/907; 83/93; 83/281; 83/468.1

[58] Field of Search ..... 83/35, 42, 44, 86, 91, 83/93, 219, 256, 268, 280, 414, 417, 419, 719, 277, 278, 281, 467.1, 468.1; 414/222, 231, 907; 100/90, 144, 152, 173, 153, 156, 210

[56] References Cited

U.S. PATENT DOCUMENTS

| | | | |
|---|---|---|---|
| 1,883,449 | 10/1932 | Andrews | 100/152 X |
| 2,376,470 | 5/1945 | Youngchild | 83/91 |
| 2,834,388 | 5/1958 | Meyer | 83/91 X |
| 3,165,956 | 1/1965 | Thumim | 83/268 X |
| 3,424,044 | 1/1969 | Thumim et al. | 83/280 X |
| 4,034,636 | 7/1977 | Pearl | 414/222 X |
| 4,036,381 | 7/1977 | Nielsen et al. | 414/222 X |
| 4,364,311 | 12/1982 | Platt, III | 83/268 X |
| 4,457,658 | 7/1984 | Meylan | 414/796 |
| 4,509,417 | 4/1985 | Brandt et al. | 100/153 X |
| 4,588,341 | 5/1986 | Motoda | 414/331 X |
| 4,641,555 | 2/1987 | Johnson et al. | 83/35 X |
| 4,720,463 | 1/1988 | Farber et al. | 414/331 X |
| 4,765,791 | 8/1988 | Brandt et al. | 414/907 X |
| 4,836,074 | 6/1989 | Mohr | 414/907 X |
| 4,984,516 | 1/1991 | Scalzitti et al. | 414/907 X |

FOREIGN PATENT DOCUMENTS

| | | | |
|---|---|---|---|
| 0091714 | 10/1983 | European Pat. Off. . | |
| 0135029 | 3/1985 | European Pat. Off. . | |
| 1144685 | 9/1963 | Fed. Rep. of Germany . | |
| 2225910 | 12/1973 | Fed. Rep. of Germany . | |
| 2449684 | 4/1975 | Fed. Rep. of Germany . | |
| 2723162 | 11/1978 | Fed. Rep. of Germany | 414/907 |
| 2758291 | 6/1979 | Fed. Rep. of Germany . | |
| 3644872 | 9/1987 | Fed. Rep. of Germany | 83/86 |

OTHER PUBLICATIONS (Speicheranlage) by the West German Firm Zoll.

Article entitled "Polar-Luftbrettanlage" pub. by A. Mohr Maschinenfabrik, 1983.

Article entitled "Polar Information 18" pub. by A. Mohr Maschinenfabrik, 1985.

*Primary Examiner*—Robert J. Spar
*Assistant Examiner*—Janice Krizek
*Attorney, Agent, or Firm*—Peter K. Kontler

[57] ABSTRACT

Apparatus for repeatedly cutting stacks of overlapping sheets has a first cutting machine from which large stacks are transferred to a loading station which is adjacent a transfer station where the stacks are loaded upon successive wheel-mounted pallets for transport into the second cutting machine. A feeding unit is provided to shift selected numbers of stacks on the pallet which is located in the second machine onto a working platform beneath the guillotine type knife and the hold-down device of the second cutting machine so that the pallet supports portions of stacks which are being severed. The stacks are oriented on the pallet at the loading station, and additional changes in orientation of the stacks can be carried out on the pallet and/or on the adjacent working platform in the second cutting machine.

1 Claim, 7 Drawing Sheets

APPARATUS FOR SEVERING STACKS OF SHEETS

This application is a continuation of application Ser. No. 038,886, filed Apr. 15, 1987, abandoned.

CROSS-REFERENCE TO RELATED CASE

The invention which is disclosed in the present case is related to that which is described in the commonly owned copending patent application Ser. No. 038,880 filed Apr. 15, 1987, now U.S. Pat. No. 4,850,257, for "Apparatus for cutting stacks of sheets".

BACKGROUND OF THE INVENTION

The invention relates to improvements in apparatus for manipulating stacks of overlapping sheets which are made of paper, metal, plastic, cardboard and/or other material. More particularly, the invention relates to improvements in apparatus which can be used with advantage to convert larger stacks of superimposed paper sheets or the like into smaller stacks and to advance the smaller stacks for processing in one or more additional treating apparatus. Still more particularly, the invention relates to improvements in apparatus which can be used with advantage to convert large stacks or piles into smaller stacks and to thereupon treat the smaller stacks, especially to subdivide smaller stacks into still smaller accumulations of overlapping sheets.

Apparatus of the class to which the present invention pertains are disclosed, for example, in a German-language publication entitled "POLAR Information 18" which was published by the West German firm A. Mohr Maschinenfabrik in 1985. Example 1 in this publication shows an apparatus wherein a pile of large sheets (made of paper, cardboard, paperboard, plastic material or the like) is accumulated on a vertically movable table and a pusher is employed to shift the pile sideways off the table and on to a cutting device. The pile comes to rest on a first or inlet section of a support for sheets at the cutting station, and such inlet section is located behind a hold-down device which presses upon the top sheet of the pile adjacent the cutting plane wherein a guillotine type knife is caused to descend and to subdivide the pile. The inlet section of the support is a stationary platform. In order to allow for ready shifting of piles, the table as well as the inlet section of the support in the apparatus which is disclosed in the German publication are provided with outlet openings for compressed air currents which form a cushion beneath the lowermost sheet of the pile. The arrangement is such that each opening contains a valving element which is depressed by the pile of sheets and permits compressed air to escape in order to form a layer of gaseous fluid beneath the lowermost sheet. The just described apparatus functions quite satisfactorily if the table and/or the inlet section of the support carries a single pile or stack of sheets. However, satisfactory manipulation of stacks is much more difficult if the table and/or the inlet section of the support is called upon to simultaneously support several stacks. Thus, the stacks are likely to move relative to each other during sidewise movement from the table onto the inlet section and/or during movement along the inlet section. This renders it necessary to orient the stacks with a very high degree of accuracy prior to cutting. The problem is especially acute if the stacks are so small that their lowermost sheets are acted upon by relatively small numbers of air currents or if their dimensions are such that they are temporarily totally out of register with air discharging openings or overlie only a single opening or a portion of a single opening.

It is further known to accumulate several piles or stacks of large sheets one above the other with the interposition of so-called air discharging boards. The boards can be moved to the level of the cutting machine and each thereof is provided with a large number of outlet openings for compressed air so as to ensure that a pile on the board can be shifted with the exertion of a relatively small effort. Reference may be had to publication No. ND 531203023d entitled "Polar-Luftbrettanlage" (published by A. Mohr Maschinenfabrik). The boards can further serve as a means for transporting stacks or piles of overlapping sheets subsequent to stacking.

Certain treatments of stacked sheets, such as bundling or baling, stamping or embossing, cutting and/or others, necessitate a highly accurate orientation of stacks prior to and during treatment. As a rule, a stack which has been delivered in an orientation that deviates considerably from the desired or necessary orientation cannot be readily caused to assume such desired orientation, i.e., it is desirable and advantageous to ensure that the treating station receive stacks in positions close to or practically coinciding with desired or optimum orientations. This saves time and reduces the likelihood of defacing of and/or other damage to the sheets of stacks which are on their way toward the treating station and must assume predetermined positions not later than at the start of a treatment, such as cutting, baling, embossing or the like.

OBJECTS AND SUMMARY OF THE INVENTION

An object of the invention is to provide a novel and improved apparatus wherein stacks of paper sheets or the like are treated in a predetermined orientation and to construct and assemble the apparatus in such a way that at least the major part of the orienting operation can be completed or practically completed before the stacks reach the treating station.

Another object of the invention is to provide an apparatus which can be used for predictable and highly satisfactory manipulation (especially cutting) of large, medium-sized, small or very small stacks with the same degree of facility and reproducibility.

A further object of the invention is to provide an apparatus which can simultaneously treat a desired practical number of stacks.

An additional object of the invention is to provide the apparatus with novel and improved means for transporting and orienting stacks on their way to a cutting or other treating station.

Still another object of the invention is to provide the apparatus with novel and improved means for storing a desired number of stacks for treatment when the primary source of stacks operates at less than capacity or is out of commission.

Another object of the invention is to provide a novel and improved method of transporting and manipulating stacks of overlapping sheets between two cutting machines.

A further object of the invention is to provide a novel and improved method of orienting and reorienting stacks of overlapping sheets which issue from a first cutting machine and are on their way to a second cutting machine.

An additional object of the invention is to provide the apparatus with novel and improved means for simultaneously orienting two or more stacks by subjecting them to the action of mechanical orienting instrumentalities in a gentle but efficient and time-saving manner so that successive series of stacks can be manipulated at short intervals.

Another object of the invention is to provide the apparatus with novel and improved means for expelling air from stacks of overlapping paper sheets or the like.

The invention is embodied in an apparatus for manipulating stacks of sheets at a treating station where the stacks are processed (e.g., oriented, compacted, trimmed and/or subdivided) and a transfer station where the stacks are accumulated and/or positioned for transfer to the treating station and the transfer station is or can be adjacent to and can receive stacks from a loading station which serves for temporary storage and/or initial orientation of stacks prior to delivery to the transfer station. The apparatus can be used with particular advantage for subdivision of stacks into smaller stacks, e.g., into stacks of superimposed discrete labels, and comprises a support including a working section at the treating station and a mobile section (e.g., a plate-like pallet mounted on rollers), guide means (e.g., including two or more horizontal rails) defining a path for movement of the mobile section between the transfer station and the treating station so that the mobile section can receive stacks from the loading station while at the transfer station for delivery of the thus received stacks to the treating station, and means (e.g., suitable stops, pushers, aligning devices, knives, stack feeders and others) for manipulating stacks at the treating station.

For example, the manipulating means can include an elongated stop for stacks at the treating station, and such stop preferably extends transversely of the path of the mobile section. The apparatus further comprises means for moving the mobile section along the path, and such moving means preferably comprises a prime mover (e.g., a reversible electric motor). Means is provided to arrest the prime mover when a stack (e.g., the foremost stack on the mobile section) reaches a position at a predetermined distance from the stop during movement of the mobile section away from the transfer station (the arresting means can comprise a conventional proximity detector switch which transmits a signal to arrest the prime mover when the foremost stack on the mobile section moves very close to or into actual contact with the stop on the working section of the support). The moving means can further comprise means for separably coupling the prime mover with the mobile section, and such coupling means can comprise a first coupling element (e.g., a socket) on or in the mobile section and a complementary second coupling element (e.g., a pawl which can penetrate into and can be withdrawn from the socket). The aforementioned moving means further comprises at least one conveyor (e.g., an endless chain conveyor) which is driven by the prime mover and serves to move the second coupling element along the path.

The means for manipulating stacks at the treating station can comprise means for feeding stacks from the mobile section at the treating station onto the working section in a direction substantially at right angles to the path. The effective length of the feeding means is preferably less than the length of the mobile section, as measured in the direction of advancement of the mobile section along its path.

The apparatus can comprise means for facilitating orientation of stacks at the loading station, and such orientation facilitating means can comprise two abutments which are disposed substantially at right angles to each other so as to allow for convenient orientation of square or rectangular stacks. One of the abutments can be coupled with means for moving it between a first level corresponding to that of the mobile section at the transfer station and a different second level at which the mobile section can bypass the abutment or at which stacks can be readily transferred from the loading station onto the mobile section at the transfer station.

The apparatus can comprise means for expelling air from between the sheets of stacks at one or more stations, preferably at the loading station. Such air expelling means can comprise a hold-down device which can be moved from above into engagement with stacks at the loading station (particularly on the mobile section if the latter is movable from the transfer station to the loading station), and an air expelling element (e.g., an elongated roller). The air expelling means further comprises means (e.g., a first motor) for urging the air expelling element against the stacks from above, and means (e.g., a second motor) for moving the air expelling element along the loading station. The air expelling element is or can be parallel to the hold-down device. The means for moving the aforediscussed mobile abutment between different levels can be used to move the hold-down device of the air expelling means into and from engagement with stacks at the loading station.

A multi-story magazine can be provided for storage of several superimposed (loaded or empty) spare mobile sections, and such apparatus further comprises means for moving the magazine relative to the transfer station so that a selected spare mobile section can be moved to the level of the path or that the mobile section which happens to be located at the transfer station can be introduced into the magazine to be replaced with a different mobile section. The arrangement is such that the entire magazine can be moved to and from a predetermined position adjacent the path for the mobile section which is in use so that an empty magazine (i.e., a magazine containing empty spare mobile sections) can be replaced with a charged magazine.

Each storey of the magazine can comprise two elongated parallel guide members (e.g., rails) which are adjacent the transfer station when the respective storey of the magazine is moved to the required level (of the transfer station). Such guide members extend transversely of the path and one thereof is nearer to the working section of the support than the other, i.e., the one guide member must be withdrawn in order to allow a mobile section to leave the storey which is located at the level of the transfer station (such storey can define the transfer station). Therefore, the apparatus comprises means for moving the one guide member out of the path (preferably by lowering the one guide member) so as to allow for advancement of the mobile section from the transfer station toward the treating station. The loading station is preferably adjacent one side of the path, e.g., immediately adjacent the magazine.

The apparatus can comprise means for releasably holding the mobile section at the transfer station to ensure that the mobile section will be held at a standstill while it receives stacks from the loading station. The holding means can include a socket at the underside of the mobile section and a male detent member which is installed at the transfer station and can enter the socket. The arrangement may be such that the means for moving the one guide member also serves to move the male detent member out of the socket preparatory to advancement of the mobile section (with a supply of stacks thereon) from the transfer station to the treating station.

As mentioned above, each mobile section can comprise a substantially plate-like pallet and rollers or wheels for the pallet. Such rollers or wheels are preferably rotated about axes which extend at right angles to the direction of advancement of the mobile section along its path.

The apparatus can comprise a first cutting machine for forming elongated strip-shaped stacks in the region of the loading station, and a second cutting machine for subdividing elongated strip-shaped stacks in the region of the working section. The first cutting machine can comprise means for subdividing large piles of superimposed sheets into elongated stacks so that each pile yields a plurality of stacks, and the second machine can include means for subdividing strip-shaped stacks into shorter stacks. The first machine can be designed to cut piles in a first cutting plane, and the second machine is preferably designed to subdivide stacks (either individually or in groups of two or more) in a second cutting plane which extends at right angles to the first cutting plane.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
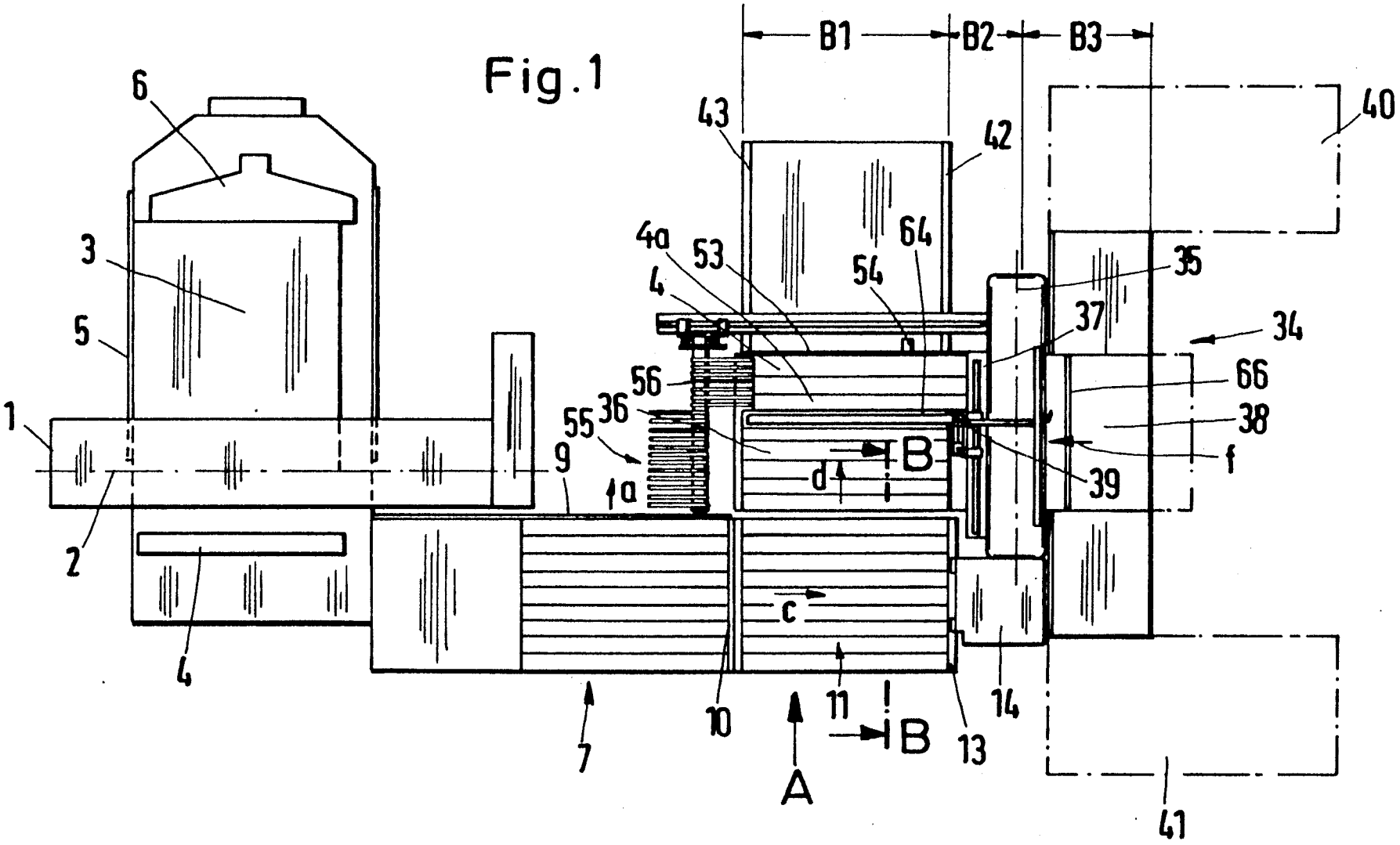
FIG. 1 is a schematic plan view of an apparatus which embodies one form of the invention and serves to convert piles of superimposed large sheets into elongated strip-shaped stacks and to thereupon subdivide strip-shaped stacks into shorter stacks.

Referring first to FIG. 1, there is shown an apparatus which serves to subdivide relatively large piles 3 of overlapping sheets of paper, cardboard, plastic or metallic material first into elongated stacks 4 and to thereupon subdivide stacks into smaller portions or stacks. The means for subdividing successive piles 3 into elongated stacks comprises a first severing or cutting machine 1 wherein a pile 3 comes to rest on a horizontal support and one of its lateral edge faces is held in abutment with a lateral stop 5. A suitable pusher 6 is provided to advance the pile 3 stepwise through increments of selected length (corresponding to the width of a stack 4) along the stop 5 and across a cutting plane 2 which is defined by a guillotine type knife (not specifically shown). The rate of feed of the pile 3 into the range of the knife is variable.

Successively formed stacks 4 are gathered on a mobile platform 8 at a loading station 7 so that the platform accumulates a group of parallel stacks 4, e.g., a group w.hich is obtained as a result of complete subdivision of an entire pile 3. The platform 8 cooperates with two elongated abutments 9 and 10 which facilitate the orientation of stacks 4 in optimum positions in such a way that the stacks are parallel to the abutment 9 and extend at right angles to the abutment 10. When the platform 8 is fully loaded, it is shifted (arrow c) in a direction to the right, as seen in FIG. 1, subsequent to slight retraction of the abutment 9 (arrow a) and a lowering (arrow b in FIG. 2) of the abutment 10 at right angles to the plane of FIG. 1 so that the platform 8 and the stacks 4 thereon can advance at a level above the lowered abutment 10. It is equally possible to raise the abutment 10 to a level above the platform 8 and the stacks 4 thereon.

Figure 2:
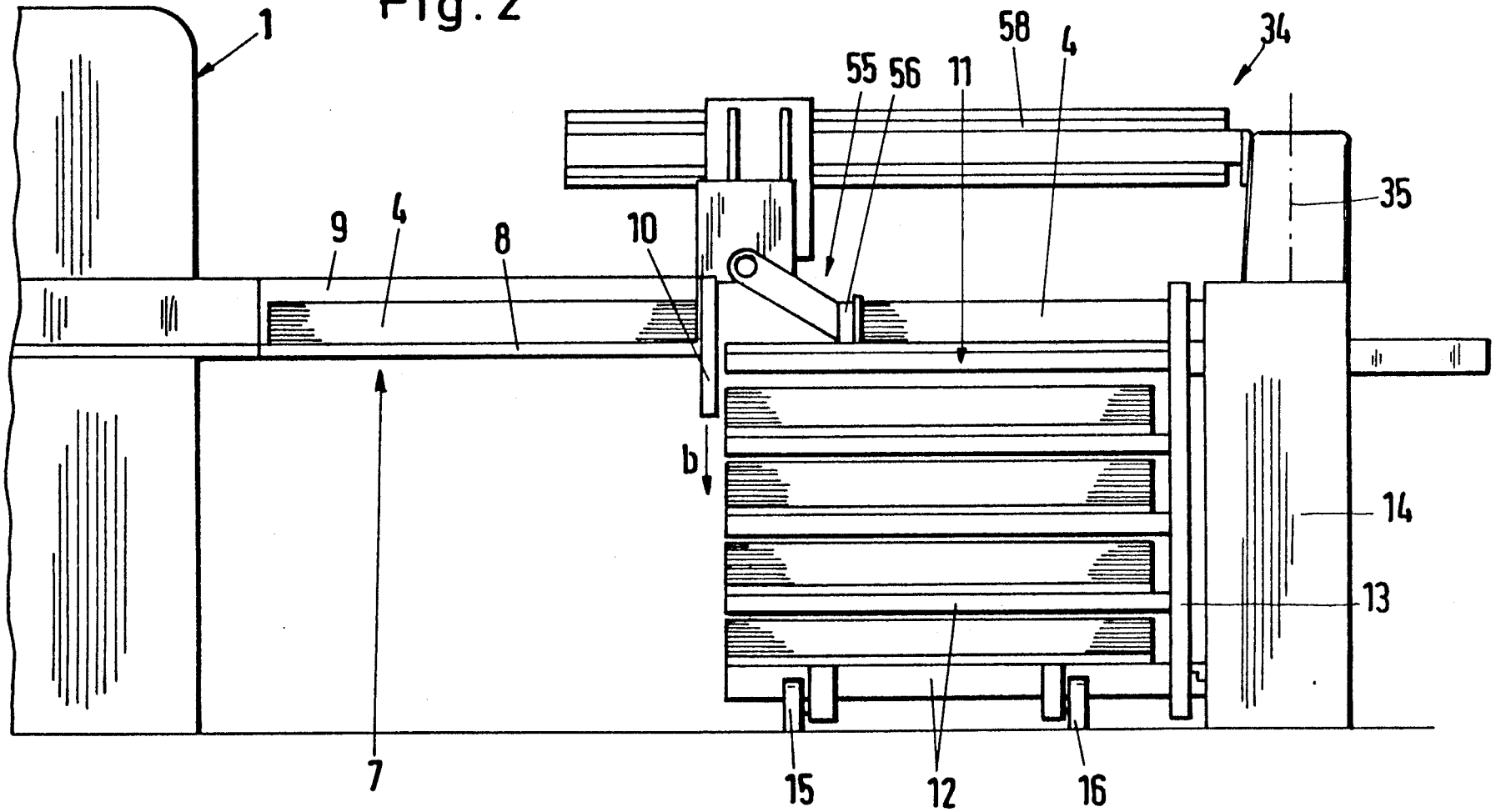
FIG. 2 is a front elevational view of the apparatus as seen in the direction of arrow A in FIG. 1.

The loaded platform 8 is advanced to a transfer station 11 where it can enter one of several storeys 12 of a vertically movable magazine 13 for a desired number of loaded platforms. FIG. 2 shows a magazine 13 with a total of four storeys 12; however, the number of such storeys can be much higher or less than four without departing from the spirit of the invention. A lifting unit 14 (e.g., one or more fluid-operated cylinder and piston assemblies) is provided to move the magazine 13 to a desired level, namely to a level at which a loaded platform 8 can enter an empty storey 12 or a loaded platform 8 can be withdrawn from a full storey 12. Each storey 12 is provided with at least two spaced parallel guide rails 17, 18 for the marginal portions of a platform 8 which can be said to constitute a pallet for temporary storage and transport of arrays of stacks 4. The magazine 13 can be provided with idler rollers and/or other suitable means for adequately supporting the platforms 8 in the respective storeys 12 as well as for permitting convenient and predictable advancement of loaded platforms into and from selected storeys. The transfer station 11 is defined by that storey 12 of the magazine 13 which is located at the level of the loading station 7, i.e., which can receive a loaded platform 8 from the station 7 or from which a loaded platform can be withdrawn for delivery into a second cutting or severing machine 34.

The magazine 13 is mounted on wheels 15 and 16 so that it can be inserted into or removed from the apparatus as a separate unit. For example, an empty magazine 13 can be rolled to a position for loading with stacks 4, and the thus loaded magazine is then returned into the apparatus or is rolled to another destination.

Figure 3:
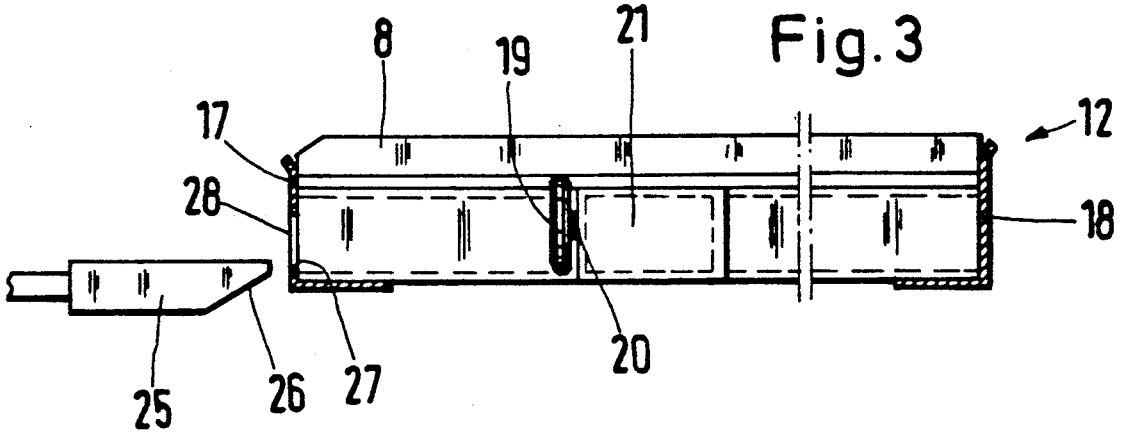
FIG. 3 is an elongated fragmentary transverse vertical sectional view as seen in the direction of arrows from the line B—B of FIG. 1 and shows the manner in which a mobile section is held by two guide rails in a storey of the magazine.
Figure 8:
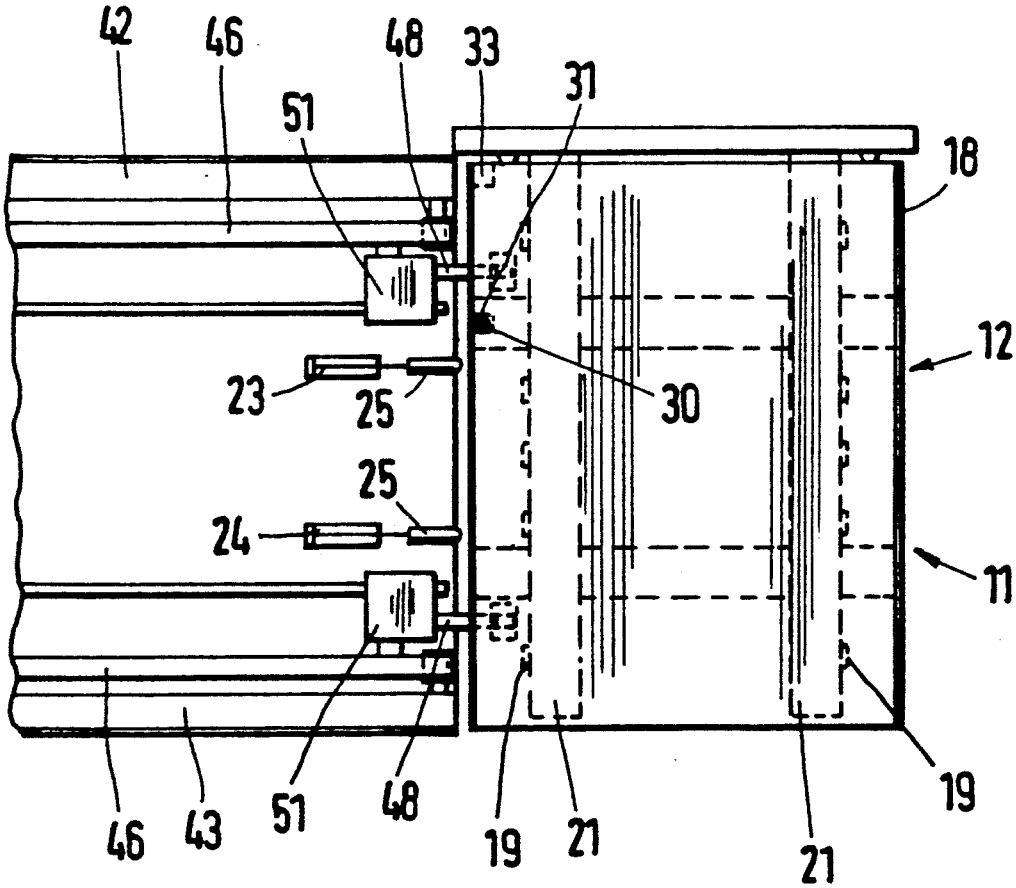
FIG. 8 is a fragmentary plan view of a storey of the magazine and of the adjacent portion of the path with means for moving mobile sections to and from the magazine as well as along the path between the transfer station and the treating station.

FIGS. 3 and 8 show that a platform 8 which forms part of a storey 12 is caused to rest on the respective guide rails 17, 18 which extend in the direction of arrow c (FIG. 1). Cylindrical rollers 19 are provided to support the platform 8 from below between the respective guide rails 17, 18 and the shafts 20 of such rollers extend at right angles to the direction which is indicated by the arrow c i.e., at right angles to the longitudinal directions of the guide rails 17, 18. The rollers 19 are preferably made from a plastic material having a low coefficient of friction. The rollers 19 form three rows and their shafts 20 are journalled in tubular bearing members 21 having a square or rectangular cross-sectional outline.

Figure 4:
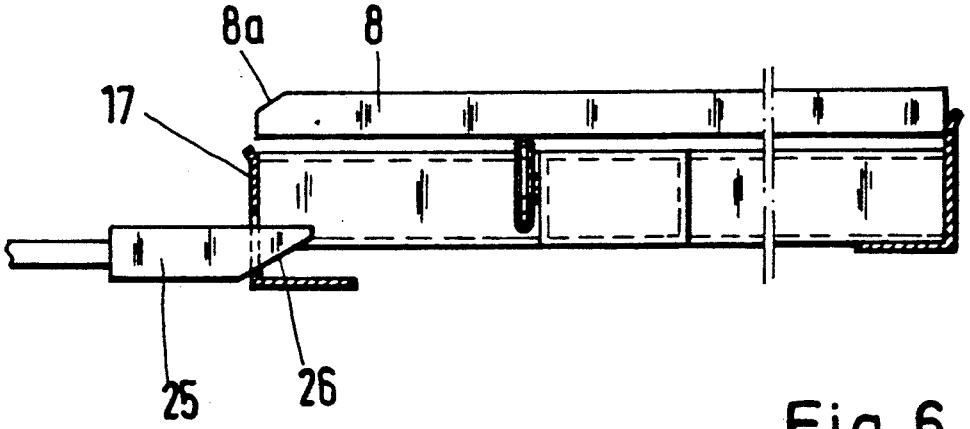
FIG. 4 shows the structure of FIG. 3 with the left-hand guide rail in lowered position so that it does not interfere with evacuation of the mobile section from the magazine.

Each guide rail 17 is mounted for movement between the raised position of FIG. 3 and a lowered position which is shown in FIG. 4 and in which the platform 8 is free to travel thereover. The means 22 for moving the rail 17 up and down comprises two fluid-operated (hydraulic or pneumatic) motors 23, 24 (FIG. 8) which can be actuated to overcome the opposition of one or more springs (not shown) tending to maintain the guide rail 17 in the raised position of FIG. 3. When the guide rail 17 has been lowered, the respective panel 8 can be advanced in the direction of arrow d (FIG. 1) into the second cutting machine 34. The piston rods of the motors 23, 24 carry wedge-like tools 25 which constitute pushers and the sloping surfaces 26 of which can engage the surfaces 27 bounding windows 28 in the adjacent guide rail 17 so as to move the rail 17 downwardly (from the position of FIG. 3 to the position of FIG. 4) when the motors 23, 24 are actuated to move the respective tools 25 in a direction to the right, as seen in FIG. 4.

Figure 6:
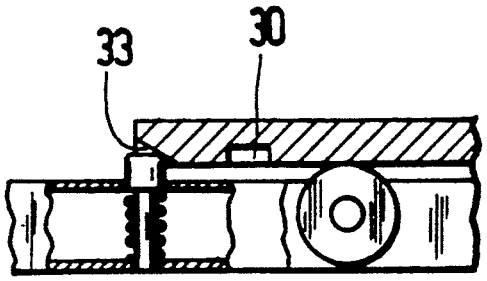
FIG. 6 illustrates the structure of FIG. 5 prior to entry of the male detent member of the holding means into the female detent member at the underside of the mobile section.
Figure 5:
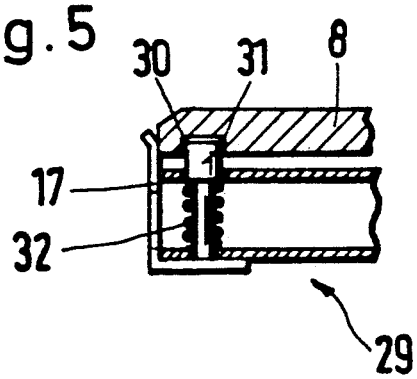
FIG. 5 is a fragmentary sectional view of a mobile section and of the adjacent vertically movable guide rail and shows the manner in which the mobile section can be releasably held at the transfer station.

The apparatus further comprises means 29 for releasably holding the platforms 8 at the transfer station 11. As shown in FIGS. 5, 6 and 8, the holding means 29 comprises a male detent member 31 which can penetrate into a recess or socket 30 at the underside of the platform 8 under the action of a coil spring 32. The shank along which the male detent member 31 is reciprocable is mounted in the respective guide rail 17. The socket 30 is located behind a cam face 33 at the underside of the marginal portion of the platform 8; the cam face 33 depresses the male detent member 31 against the opposition of the spring 32, and the latter thereupon expands as soon as the member 31 moves into register with the socket 30. The member 31 leaves the socket 30 in automatic response to lowering of the guide rail 17 to the position of FIG. 4.

The second cutting machine 34 is adjacent the transfer station 11 and its guillotine type knife is movable in a vertical cutting plane 35 which is indicated by a dot-dash line. The machine 34 includes a support defining a substantially horizontal supporting surface for stacks 4 and being composed of a first section 36 which receives stacks 4 from the station 11, a second section 38 which receives severed portions of stacks 4, and a working section 37 between the first and second sections 36, 38. The section 36 occupies the region or zone Bl (FIG. 1) of a treating station, the section 37 occupies the region or zone B2, and the section 38 occupies the region or zone B3 of the treating station. The section 36 is constituted by the mobile platform 8 which has left the transfer station 11 and has been advanced into the treating station B114 B3 in the second cutting machine 34. The latter further comprises a conventional hold-down device which is adjacent the cutting plane 35 and serves to exert pressure upon the stack or stacks 4 which are about to be and which are being severed by the knife in the cutting plane 35. A biasing device 39 is provided above the section 37 to urge the stack or stacks 4 to be severed toward an elongated stop 53 which extends at right angles to the cutting plane 35. Those portions of stacks 4 which are separated from the remaining portions of such stacks can be transported to the locale of use, to storage, to a first processing machine 40 (e.g., a bundling or baling machine) or to a second processing machine 41 (e.g., a stamping or embossing machine). The machines 40 and 41 are optional and are shown in FIG. 1 schematically by phantom lines.

Figure 7:
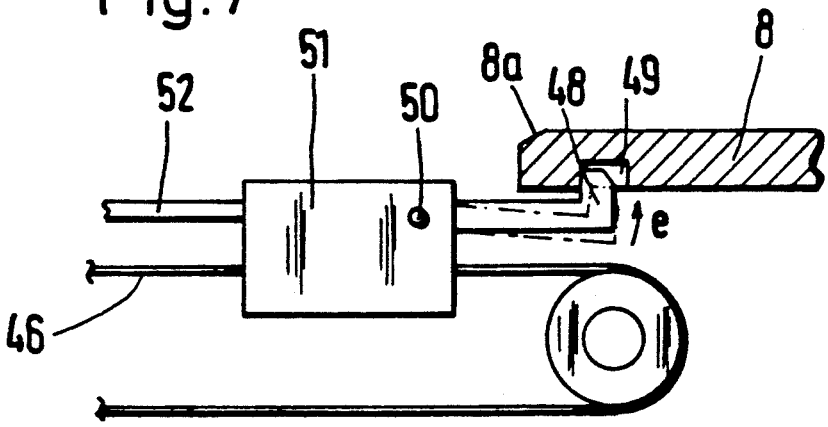
FIG. 7 is a fragmentary sectional view of a mobile section and further shows the manner in which the mobile section is releasably coupled to the means for moving it between the transfer station and the treating station.

The second cutting machine 34 comprises two guide members 42 and 43 which extend into the region B1 downstream of the stop 53 (as seen in the direction of arrow d) and define a path for movement of platforms 8 between the transfer station 11 and the treating station B1–B3. Motor-driven means 44–52 is provided for advancing a loaded platform 8 along the guide members 42, 43 to a position adjacent the working section 37 of the support in the machine 34. The moving means includes a reversible electric motor 44 (FIG. 9) which drives a sprocket wheel 45 for two endless chains 46 carrying housings 51 (FIGS. 7 and 8) for pivot members 50 which support pivotable hook-shaped male coupling members 48. The chains 46 are further trained over idler sprocket wheels 47. The pallets of the coupling members 48 can be caused to penetrate into complementary depressions or sockets 49 in the underside of the platform 8 at the transfer station 11. Each housing 51 contains a motor which serves to pivot the respective coupling member 48 so that the pallet of the respective member 48 enters into or is withdrawn from the adjacent socket 49. The housings 51 can contain hydraulic, pneumatic, electric or other types of motors which are started, reversed and arrested by remote control. FIG. 7 shows a conductor 52 which serves to connect the motor in the respective housing 51 with a control panel or with a programming circuit, not shown. The direction in which the coupling member 48 of FIG. 7 must pivot in order to insert its pallet into the adjacent depression 49 is indicated by arrow e. When the coupling member 48 of FIG. 7 assumes the solid-like position of FIG. 7, the motor 44 is started in a direction to advance the respective platform 8 from the transfer station 11 into the machine 34 (arrow d) or to advance the platform again upon completion of a first cutting operation which has merely involved a subdivision of one or more but not all stacks 4 on such platform.

When the leading edge of the platform 8 reaches the stop 53, its chamfered cam face 8a (FIG. 7) raises the stop 53 so that the platform can continue to move in the direction of arrow d until the motor 44 is arrested by a proximity detector switch 54 (FIG. 1). The switch 54 transmits a signal to stop the motor 44 when the foremost stack 4 on the platform 8 which advances in the direction of arrow d is immediately or closely adjacent to or actually contacts the stop 53. This ensures that the foremost stack or stacks 4 on the platform 8 which has lifted the stop 53 actually assume or are very close to their optimum positions for severing by the guillotine type knife of the machine 34.

Figure 10:
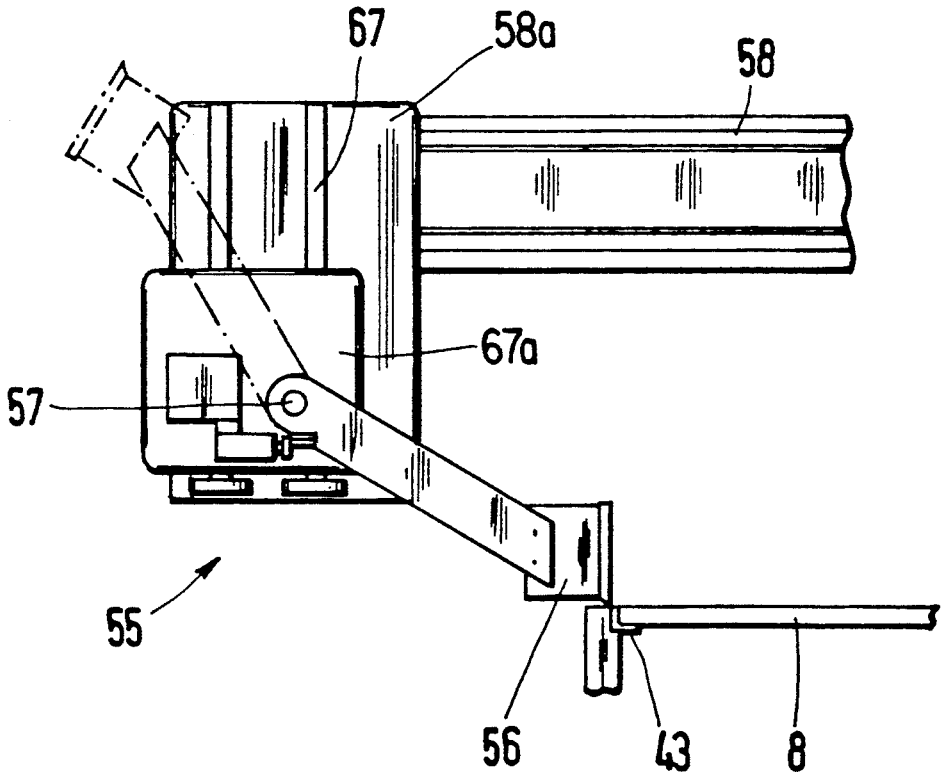
FIG. 10 is an enlarged fragmentary side elevational view of the means for feeding stacks from a mobile section onto the working section of the support.

The apparatus further comprises a feeding unit 55 which serves to shift the foremost stack or stacks 4 on the platform 8 in the zone B1 toward and across the cutting plane 35. The feeding unit 55 is of variable effective length and, to this end, comprises a row of preferably identical segments or portions 56 (see particularly FIG. 10) each of which is pivotable about the horizontal axis of a pivot member 57 between the solid-line (operative) and the phantom-line (inoperative) position of FIG. 10. The segments 56 are mounted on lever arms which are mounted on the pivot member 57. The pivot member 57 is mounted on a first carriage 67*a* which is movable carriage 58*a* which, in turn, is movable along horizontal ways 58 in the frame of the improved apparatus. The motors which drive the carriages 67*a*, 58*a* along the respective ways are not shown in the drawing. The purpose of the carriage 58*a* is to feed the operative segment or segments 56 of the feeding unit 55 in a direction to the right, as seen in FIG. 10, so as to advance the selected foremost stack or stacks 4 a desired distance across the cutting plane 35. The carriages 67*a* and 58*a* further cooperate to move the feeding unit 55 back to its starting position while permitting the motor 44 to simultaneously advance the platform 8 along the guide members 42 and 43.

FIG. 1 shows a selected number of segments 56 in operative positions; the selected number suffices to push three foremost stacks 4 on the platform 8 which constitutes the section 36 toward and across the cutting plane 35 in the machine 34. As mentioned above, such movement is effected by the carriage 58*a* which is movable along the horizontal ways 58 (these ways extend at right angles to the cutting plane 35, i.e., in parallelism with the stop 53).

Figure 9:
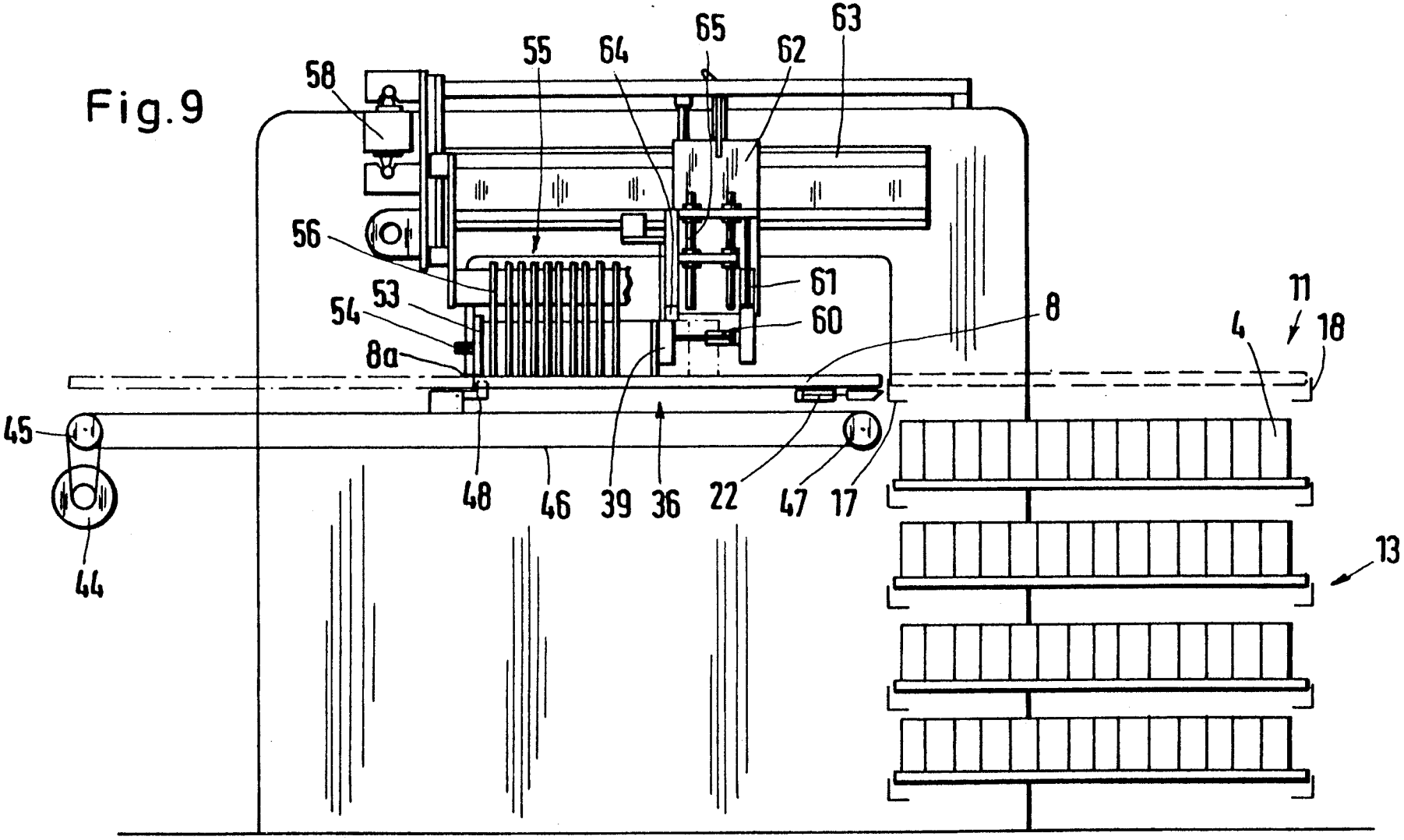
FIG. 9 is a rear elevational view of the apparatus.

The biasing device 39 is a pusher which can urge the selected number of stacks 4 on the platform 8 in the zone B1 toward the stop 53, i.e., in the direction of arrow d, so as to ensure an accurate alignment of such stacks with the stop 53 and hence a predictable orientation of these stacks with reference to the knife of the cutting machine 34. The biasing device 39 operates in close proximity to the cutting plane 35 and is disposed at a level above the working section 37. The means for preferably repeatedly moving the biasing device 39 in the direction of arrow d comprises a servomotor 60 (FIG. 9). A further motor 61 (which carries the motor 60) is used to change the level of the biasing device 39. The motors 60 and 61 are mounted on a slide or carriage 62 which is reciprocable along horizontal ways 63 forming part of or fixedly mounted in the frame of the machine 34.

A retaining or pressing device 64 is movable up and down by one or more motors 65 on the carriage 62 to engage from above the foremost stack 4*a* (FIG. 1) which is not in the range of operative segments 56 of the feeding device 55 so that the orientation of the stack 4*a* (and of the stacks behind the stack 4*a*) does not change while the operative segments 56 push the three foremost stacks 4 toward and across the cutting plane 35.

Still further, the apparatus comprises an aligning device 66 which is parallel to the cutting plane 35 and is disposed above the section 38 of the support in the machine 34. The purpose of the aligning device 66 is to repeatedly engage the front edge faces of the three foremost stacks 4 on the platform 8 which constitutes the section 36 and to ensure that each and every sheet of each of these stacks abuts the respective segment or segments 56 in the course of the severing operation. Thus, each selected stack 4 is properly oriented as a result of cooperation of operative segments 56 of the feeding device 55 with the aligning device 66 as well as due to cooperation of the stop 53 with the biasing device 9. The direction in which the aligning device 66 is movable by its motor or motors is indicated by the arrow f (FIG. 1).

As a rule, the distances which must be covered by the biasing device 39 (arrow d) and by the aligning device 66 (arrow f) are minimal due to preliminary orientation of stacks 4 at the loading station 7 as well as due to engagement of the foremost stack 4 on the platform 8 in the zone B1 with the stop 53. The severing operation follows whereby the separated portions of the three foremost stacks 4 come to rest on the section 38 at the right-hand side of the cutting plane 35 shown in FIG. 1.

The next step involves renewed feeding of the shortened foremost stacks 4 by the respective segments 56 of the feeding unit 55 which is advanced by the carriage 58*a* along the ways 58 so that the machine 34 can perform a second cut in order to further reduce the length of the three foremost stacks 4. Each cutting step is preferably preceded by a renewed orientation of the stacks 4 which are about to be severed so as to even further reduce the likelihood of improper orientation in the course of a cutting operation.

When the three foremost stacks 4 are consumed, the feeding unit 55 is retracted to its starting position (this involves a lifting by the carriage 67*a* along the ways 67 and a subsequent shifting by the carriage 58*a* along the ways 58 in a direction to the left, as seen in FIG. 10). The motor 44 can be started to advance the platform 8 in the direction of arrow d as soon as the carriage 67*a* has lifted the feeding unit 55 above the level of stacks 4 on the platform 8 which rests on the guide members 42 and 43. The proximity detector switch 54 arrests the motor 44 to bring the platform 8 on the guide members 42, 43 to a halt when the foremost stack 4 is sufficiently close to the stop 53. The carriage 58*a* then advances the feeding device 55 in a direction to the right, as seen in FIG. 1, so as to move a selected number of stacks 4 toward and across the cutting plane 35 prior to making of the first cut. The biasing device 39 cooperates with the stop 53, and the aligning device 66 cooperates with the operative segments 56 prior to each cutting operation to thus ensure that the stacks 4 or portions of stacks are invariably moved to optimum positions for severing by the knife of the machine 34. The feature that the carriage 67*a* can lift the feeding unit 55 above the level of stacks 4 on the platform 8 which rests on the guide members 42, 43 contributes significantly to the output of the improved apparatus because retraction of the unit 55 to its starting position (by means of the carriage 58*a*) can take place simultaneously with advancement of the platform 8 along the guide members 42, 43 in order to move one or more fresh stacks 4 into the range of operative segments 56 of the feeding unit 55.

When the platform 8 on the guide members 42, 43 is empty, the direction of operation of the motor 44 is reversed so that the empty platform 8 is returned into an empty storey 12 of the magazine 13. The lifting means 14 is then actuated to raise or lower the magazine 13 in order to place a loaded storey 12 into the position of register with the transfer station 11, i.e., to enable the advancing means including the male coupling member 48 to extract the loaded platform 8 from such storey 12 and to advance the platform along the path which is defined by the guide members 42, 43 until the motor 44 is arrested by a signal from the proximity detector switch 54.

If the magazine 13 is empty or has been wheeled away for loading, the empty platform 8 can be moved to the station 7 for loading with freshly cut stacks 4.

Figure 11:
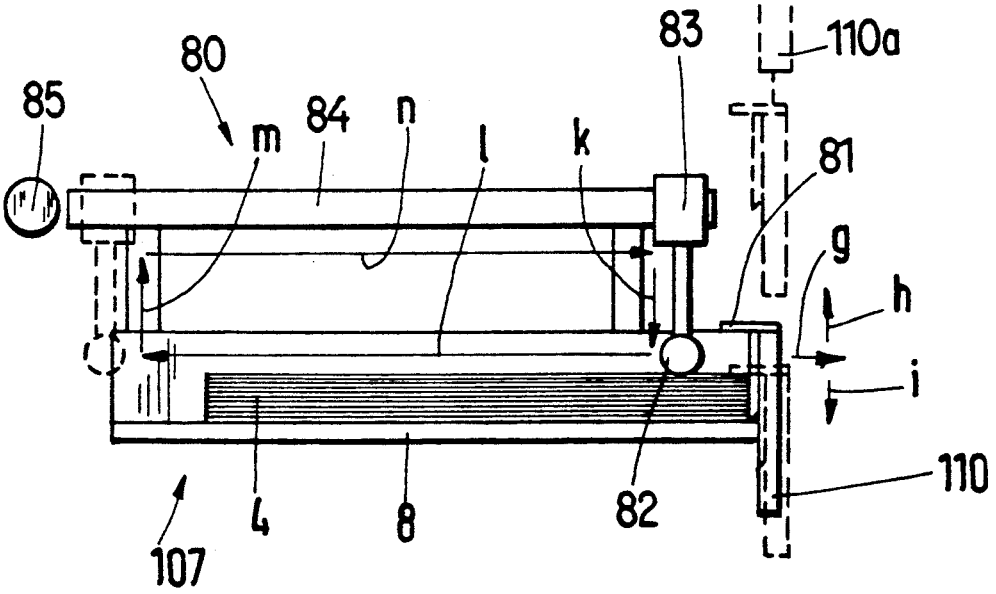
FIG. 11 is a fragmentary front elevational view of a modified apparatus which is provided with means for expelling air from stacks at the loading station.

FIG. 11 shows a portion of a modified apparatus having a different loading station 107. The platforms which are used in this modified apparatus are (or can be) identical with the platforms 8 which are shown in FIGS. 1 to 10. It is further assumed that the loading station 107 receives stacks 4 which are formed in the same way as described in connection with the cutting machine 1 of FIG. 1. The abutment 110 is movable upwardly (arrow h) by a servomotor 110*a* so that it is lifted above the level of stacks 4 on the adjacent platform 8 and enables the platform to advance in the direction of arrow g. The arrangement is preferably such that the abutment 110 is first caused to cover a short distance in the direction of arrow g and is thereupon caused to move upwardly (arrow h).

The apparatus of FIG. 11 further comprises means 80 for expelling air from the stacks 4 on the platform 8 which occupies the loading station 107. The expelling means 80 comprises a pressure applying elongated strip-shaped hold-down device 81 which forms part of the abutment 110 and overlies the platform 8 at the loading station 107. When the abutment 110 completes its movement in the direction of arrow g, it can first move downwardly (arrow i) so that the member 81 engages the adjacent marginal portions of topmost sheets of the stacks 4 on the platform 8. The motor 110*a* (e.g., a pneumatic cylinder and piston unit) is used to move the abutment 110 and its hold-down device 81 downwardly so that the device 81 bears upon the adjacent topmost sheets with a required force which suffices to hold the sheets of stacks 4 against stray movements. The expelling means 80 further comprises a rotary roller-shaped air expelling element 82 (particularly an idler roller) mounted on the lower end portion of an arm which is carried by a motor 83 reciprocable along one or more horizontal guides 84 at a level above the platform 8, i.e., above the loading station 107. The motor 83 can move the idler roller 82 up and down (arrow k). In the next step, the motor 83 is moved along the guide or guides 84 (arrow n) prior to lifting of the roller 82 in the direction of arrow m. A further motor 85 is provided to move the motor 83 along the guide means 84, e.g., by way of a belt or chain transmission.

The provision of air expelling means 80 even further reduces the likelihood of stray movement of sheets during transport from the loading station 107 into the second cutting machine 34 and/or during orientation and severing in the second cutting machine.

The operation of the entire apparatus, but particularly of the second cutting machine 34 and of the means for supplying stacks 4 to the machine 34, can be automated to any desired extent. Furthermore, it is possible to automate the transfer of subdivided stacks 4 to storage, to locales of use or to the processing machine 40 or 41. Reference may be had to the aforementioned commonly owned copending patent application. The extent of automation is preferably such that a single person can service the first cutting machine 1 and simultaneously monitor the operation of the second cutting machine 34 and of the means for delivering stacks 4 from the machine 1 into the machine 34. The single attendant will normally operate the machine 1 in order to form a series of stacks 4, and such attendant will, if necessary, transfer freshly formed stacks 4 from the machine 1 onto the loading station 7 or 107.

An important advantage of the improved apparatus is that a stack 4 which has been deposited on a platform 8 at the loading station 7 or 107 remains on the platform during transport toward and all the way into the second cutting machine 34. This greatly reduces the danger of misorientation of discrete stacks and/or groups of stacks on their way toward treatment in the second cutting machine. Therefore, and if the stacks 4 are properly oriented by the abutments at the loading station 7 or 107, additional orienting instrumentalities (such as the biasing means 39 and the aligning device 66) constitute primarily a safety feature which even more reliably ensures predictable orientation of stacks 4 in the second cutting machine 34. The guide rails 42, 43 define for the mobile platform 8 (which is on its way from the loading station 7 or 107 or from the transfer station 11 toward the treating station B1–B3) a predetermined path so that a stack 4 which has been properly positioned on such platform at the loading station will remain in proper position on its way toward the working section 37 of the support 36–38 in the second cutting machine 34.

The feature that the platform 8 on the guide rails 42, 43 forms one section (36) of the composite support 36–38 for stacks 4 in the second cutting machine 34 contributes to greater simplicity of this machine and of the entire apparatus. Furthermore, such design renders it possible to reduce the overall dimensions of the apparatus, especially as concerns the distance from the transfer station 11 to the treating station B1–B3. It is not necessary to provide means for transferring stacks 4 first from a platform 8 into the second cutting machine 34, i.e., the feeding unit 55 suffices to advance selected numbers of stacks 4 onto the working section 37 without the danger of misorientation so that the orienting means at the station B1–B3 must effect minimal (if any) changes in orientation of stacks which overlie or are about to overlie the working section 37.

The placing of the stop 53 at right angles to the direction (arrow d) of movement of stacks 4 with a platform 8 on the guide rails 42, 43 also contributes to simplicity and compactness of the apparatus because the platform 8 can move the foremost stack 4 all the way into abutment with, or into close or immediate proximity of, the stop 53. This entails an automatic correction of orientation (if necessary) of stacks which are to be shifted by the active segments 56 of the feeding unit 55 or a rather simple manual adjustment of the orientation of stacks which are about to be severed in the cutting machine 34. Manual adjustment will be needed if the proximity detector switch 54 is designed to arrest the platform 8 on the guide rails 42, 43 before the foremost stack 4 on this platform reaches the stop 53 The motor 44 cooperates with the switch 54 to automatically advance the platform 8 on the guide rails 42, 43 in stepwise fashion so as to place a selected number of stacks 4 into register with the active segments 56 of the feeding unit 55. The switch 54 can be replaced by other arresting means, e.g., by a mechanical sensor or by a photoelectronic detector.

The provision of means (48, 49) for separably coupling the motor 44 with a platform 8 on the guide rails 42, 43 contributes to simplicity and lower cost of the apparatus because it is not necessary to provide each platform 8 with a discrete prime mover.

The feature that the effective length of the feeding unit 55 is or can be less than the length of a platform 8 (as measured in the direction of arrow d) renders it possible to use the feeding unit for transfer of a desired number of stacks 4 onto the working section 37 of the support in the second cutting machine 34. This reduces the likelihood of misorientation of stacks during transfer onto the working section 37. It has been found that the just discussed ratio of effective length of the feeding unit 55 to the length of a platform 8 is particularly advantageous when the apparatus is used to manipulate relatively small or very small stacks.

The provision of abutments 9, 10 and/or similar abutments at the loading station 7 or 107 constitutes an optional but desirable feature of the apparatus. Such abutments allow for an accurate initial or preliminary orientation of stacks 4 so that the thus oriented stacks require a minimum of additional or final orientation or no final orientation at all. It often suffices to employ a single abutment but the use of two abutments which are disposed at right angles to each other is recommended when the apparatus is to treat rectangular or square stacks. The movability of the abutment 10 or 110 to a level above or below the path for platforms from the loading station 7 or 107 into the transfer station 11 contributes to compactness of the apparatus because the loading and transfer stations can be located in immediate proximity to each other.

Expulsion of air from stacks 4 which are about to leave the loading station 107 is desirable and advantageous because this even further reduces the likelihood of misorientation of stacks on their way toward and into the second cutting machine 34. This is especially important when the stacks 4 resemble elongated narrow strips which are likely to become interlaced if the entrapped air allows for ready shifting of superimposed layers of a stack relative to one another. While it is possible to provide a separate motor to move the hold-down device 81 of the air expelling means 80 of FIG. 11 relative to the adjacent stacks 4 on the platform 8 which occupies the loading station 107, the mounting of hold-down device 81 on the vertically movable abutment 110 obviates the need for an additional motor and thus contributes to simplicity and lower cost of the apparatus.

The magazine 13 also constitutes an optional feature of the apparatus. This magazine can be used for storage of loaded platforms 8 which are withdrawn when the cutting machine 1 is idle or operates at less than capacity, for storage of empty platforms if the empty platforms are not or cannot be evacuated by moving in the direction of arrow d beyond the section B1 of the treating station in the second cutting machine 34, as well as to allow for loading of platforms 8 at a location other than the loading station 7 and 107 and for subsequent wheeling of the loaded magazine back to the position which is shown in the drawing. In addition to being mounted on wheels 15 and 16, the magazine 13 can be equipped with its own motor for transport to and from a position adjacent the path which is defined by the guide rails 42 and 43.

The provision of means 29 for holding a platform 8 in a predetermined position at the transfer station 11 renders it possible to automate the operation of means (44–52) for moving the platforms 8 along the path which is defined by the guide rails 42, 43 because the male coupling member 48 can automatically advance to a position of engagement with the socket 49 at the underside of the platform 8 which is engaged by the holding means 29. The male detent member 31 constitutes a very simple and inexpensive means for rapidly and reliably locating the platform 8 at the transfer station 11 in a predetermined position with reference to the moving means 44–52. Moreover, the male detent member 31 can be automatically separated from the socket 30 by the simple expedient of lowering the respective guide rail 17 preparatory to transfer of the platform from the station 11 into the station B1–B3.

The rollers or wheels 19 at the undersides of platforms 8 are particularly desirable if the platforms are to be shifted by hand, e.g., between the transfer station 11 and the loading station 7 or 107. While it is possible to replace the rollers or wheels 19 with casters, it normally suffices to provide wheels or rollers each of which is rotatable about a single axis, namely at right angles to the direction of movement of platforms along the path which is defined by the guide rails 42 and 43.

The assembly of cutting machines 1 and 34 in a manner as shown in FIG. 1 has been found to contribute to compactness of the apparatus as well as to reduce the likelihood of misorientation of stacks 4 (even very small stacks) on their way from the loading station 7 (which is immediately adjacent the machine 1 and the transfer station 11) to the treating station B1–B3. The provision of feeding means 55 which can transfer selected numbers of stacks 4 directly from a platform 8 onto the working section 37 of the support in the second cutting machine 34 also enhances the compactness of the apparatus and reduces the likelihood of misorientation of stacks prior to engagement by the hold-down device of the machine 34.

The aforedescribed apparatus can be modified in a number of additional ways without departing from the spirit of the invention. For example, the motor 44 need not be used to return empty platforms 8 into empty storeys 12 of the magazine 13. Instead, an empty platform 8 can be evacuated by moving it in the direction of arrow d (FIG. 1) beyond the second cutting machine 34. Moreover, all motors which are used in the improved apparatus can constitute pneumatic, hydraulic, electric or other motors, or the apparatus can employ different types of motors The loading station 7 or 107 can be bodily separated from the first cutting machine 1 and/or from the second cutting machine 34. Alternatively, the preliminary orientation of stacks 4, the loading of stacks onto platforms 8 and the transfer of stacks to the second machine 34 can take place at one and the same station. Moreover, the platforms 8 can be provided with means for developing air cushions so as to facilitate shifting of the stacks 4 along their upper sides. Suitable platforms or pallets with air cushions are disclosed, for example, in German Offenlegungsschrift No. 2 225 910 of Baumann. The arrangement may be such that the means for forming an air cushion in a particular platform 8 is connected with an outside source of compressed air during loading of the platform at the station 7 or 107 and/or during shifting of one or more stacks 4 along the upper side of the platform by one or more operative segments 56 of the feeding device 55.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for manipulating stacks of paper sheets at a treating station where the stacks are subdivided into smaller stacks and a transfer station at which the stacks are positioned for transfer to the treating station, comprising a support including a working section at the treating station and a mobile section; guide means defining a path for movement of the mobile section between the transfer station and the treating station so that the mobile section can deliver stacks to the treating station; means for manipulating stacks at the treating station; means defining a loading station adjacent said transfer station and arranged to support stacks prior to delivery to said transfer station; and means for expelling air from between the sheets of stacks at said loading station, including an elongated hold-down device for stacks on the mobile section, an air expelling element including an elongated roller which is parallel to said hold-down device, and means for urging said air expelling element against the stacks on the mobile section from above and for moving said element along the mobile section.

* * * * *